US008836160B1

(12) United States Patent
Paterson et al.

(10) Patent No.: US 8,836,160 B1
(45) Date of Patent: Sep. 16, 2014

(54) METHOD AND APPLICATION FOR VEHICLE POWER SYSTEM ISOLATION

(75) Inventors: John T. Paterson, Mukilteo, WA (US); Donald B. Lee, Shoreline, WA (US); Terrance L. Thomas, Covington, WA (US); Richard W. Berman, Sammamish, WA (US); George Liang, Bothell, WA (US)

(73) Assignee: The Boeing Company, Chicago, IL (US)

( * ) Notice: Subject to any disclaimer, the term of this patent is extended or adjusted under 35 U.S.C. 154(b) by 487 days.

(21) Appl. No.: 12/892,871

(22) Filed: Sep. 28, 2010

(51) Int. Cl.
*H01F 3/00* (2006.01)

(52) U.S. Cl.
USPC ..... 307/9.1

(58) Field of Classification Search
CPC ..... Y02T 50/52
USPC ..... 307/9.1, 10.1
See application file for complete search history.

(56) References Cited

U.S. PATENT DOCUMENTS

| | | | | |
|---|---|---|---|---|
| 3,717,876 | A * | 2/1973 | Volkers et al. | 343/712 |
| 5,291,829 | A * | 3/1994 | Avory et al. | 102/202.2 |
| 5,761,791 | A * | 6/1998 | Bando | 29/609 |
| 5,926,115 | A * | 7/1999 | Schleder et al. | 340/953 |
| 6,040,753 | A * | 3/2000 | Ramakrishnan et al. | 336/223 |
| 6,141,194 | A * | 10/2000 | Maier | 361/58 |
| 6,475,351 | B2 * | 11/2002 | Sun et al. | 204/164 |
| 6,726,857 | B2 * | 4/2004 | Goedde et al. | 252/570 |
| 7,148,779 | B2 * | 12/2006 | Wolfgram | 336/70 |
| 7,394,340 | B2 * | 7/2008 | Kakehashi et al. | 336/180 |
| 8,191,540 | B2 * | 6/2012 | Visser et al. | 123/598 |
| 8,354,911 | B2 * | 1/2013 | Visser et al. | 336/212 |
| 2002/0145416 | A1 * | 10/2002 | Attarian et al. | 324/127 |
| 2003/0164479 | A1 * | 9/2003 | Goedde et al. | 252/570 |
| 2007/0132535 | A1 * | 6/2007 | Kakehashi et al. | 336/182 |
| 2008/0071260 | A1 * | 3/2008 | Shores | 606/34 |
| 2009/0188458 | A1 * | 7/2009 | Visser et al. | 123/169 R |
| 2011/0254505 | A1 * | 10/2011 | Evander et al. | 320/109 |

OTHER PUBLICATIONS

Akihiko Yagasaki, "Isolation Transformers to Prevent the Propagation of Lightning Surges along Power Lines: the Problem Involved and the Effects of the Improvement", J. Inst. Electrostat. Jpn., vol. 25, Issue 6, 2001, p. 311-319, Seidenki Gakkai, Japan (English Abstract).
RTCA Special Committee 135 (SC-135), "Environmental Conditions and Test Procedures for Airborne Equipment", DO-160F, RTCA, Inc., 2007, Sections 15, 17, 22, 23, and 25.

(Continued)

*Primary Examiner* — Adi Amrany
(74) *Attorney, Agent, or Firm* — Kevin G. Fields

(57) ABSTRACT

Presented is a system and method for providing electrical isolation in vehicle power systems. The method comprises placing linear optimized isolation transformers in structures of a vehicle at positions that minimize the propagation of energy spikes into internal electronic systems, for example in the wing root of an aircraft where electrical cables from a generator associated with an engine enter the fuselage. The system includes a linear optimized isolation transformer with a core that has primary side winding isolated from a secondary side winding by an isolation dielectric. The isolation dielectric maintains a high value isolation independent of pressure differences due to operation at different altitudes. In embodiments, linear optimized isolation transformers for each phase of a power distribution system couple power from a generator through a structure of a vehicle thereby increasing electrical isolation of electrical components inside the structure from electrical surges originating outside the structure.

15 Claims, 6 Drawing Sheets

(56) References Cited

OTHER PUBLICATIONS

RTCA Special Committee 180 (SC-180), "Design Assurance Guidance for Airborne Electronic Hardware", DO-254, RTCA, Inc., 2000.
SAE Aerospace, "Aircraft Lightning Zoning", ARP5414 Rev. A, SAE International, 2005.
Department of Defence, "Requirements for the Control of Electromagnetic Interference Characteristics of Subsystems and Equipment", MIL-STD-461F, 2007.
Fisher, F.A. et al., *Lightning Protection of Aircraft, Second Edition*, 2004, published by Lightning Technologies Inc., Pittsfield, MA, Fig. 15.1 and Fig. 15.23, pp. 486, 500.

* cited by examiner

METHOD AND APPLICATION FOR VEHICLE POWER SYSTEM ISOLATION

FIELD

Embodiments of the subject matter described herein relate generally to a system and method for providing electrical isolation for vehicle power systems.

BACKGROUND

Aerospace vehicles such as aircraft are susceptible to lightning strikes and other high intensity radiated fields (HIRF), or collectively voltage spikes or energy spikes. Voltage spikes and induced surges have the potential of interrupting the operation of electrical and control systems within the vehicles. In low-impedance systems, for example in power wiring, induced surges become high-current surges which can trip circuit breakers off-line and disrupt airplane services. In high-impedance systems, for example electronics, induced high-voltage spikes can trip logic, and damage semiconductor avionics. Current generations of aircraft use multiple low-voltage microprocessors, semiconductor devices, and high-frequency data busses, all of which are sensitive to voltage spikes. To mitigate these effects, protection in the form of shielding is used.

For example, in present airplanes with metal fuselages, and especially those produced in last 20 years, at least 90% of the protection required is achieved through the use of metallic shields on critical wiring and cable bundles. The demonstrated best-practice for such shielding (see e.g., "Lightning Protection of Aircraft", Lightning Technologies Inc., Fisher, 2004 (LTI), Ch. 15, FIG. 15.1) is a copper-braid tube wrap on the entire bundle, terminated at each end by a bonded-ring to the connector back-shell, or other grounding methods depending on each individual case (see e.g., LTI, Ch. 15, FIG. 15.23.) While shielding has been proven to work quite well in metal airplanes by reducing the external effects by about 6 dB, it still leaves equipment exposed to 1500V spikes and 3000 Amp current surges (see Standards defined in "Environmental Conditions and Test Procedures for Airborne Equipment", RTCA-DO-160E, RTCA Incorporated, 2007 (RTCA-DO-160E), Section 22, 23.) Because of these exposures, Line Replaceable Units (LRU's) typically include levels of internal protection to prevent damage, at extra cost and weight. Skilled workmanship is necessary to design and install copper-braided bundle-shields, and during their lifetime end-terminations are exposed to temperature-stress, current surges, and work-hardening breakages due to cable flexing. Special certification procedures are required for cable-shielding to demonstrate effectiveness to the FAA. Also, life expectancy has to be proven to the FAA, as shields are prone to coming loose and breakages are common.

Transformers used for Transformer-Rectifier 28 Vdc Units (TRU's) do provide some isolation, due in part because the secondary is not connected to the primary, but the isolation is nominal and provides only about −6 dB for the 400 Hz due to the 4:1 turns ratio. This protection is deemed acceptable for metal airplanes under RTCA-DO-160E design rules. Other traditional terrestrial solutions such as metal-oxide varistors (MOV's), diodes etc, have not been used mainly because they are not fault-tolerant, and a single latent-failure renders them useless for airplane purposes.

These solutions serve to mitigate the damage to electronics once a voltage spike is present in the vehicle, but do not prevent the voltage spike from entering the vehicle itself. Many fuselages of aircraft are constructed of metal, which provides some protection to the internal wiring and systems by inhibiting the flow of charge from outside into the enclosed metal fuselage. An enclosed metal structure is sometimes referred to as a "Faraday Cage." In some vehicles, an additional enclosed metal compartment is created within the fuselage to further house and protect flight essential electronics and electrical systems from voltage spikes. However, a recent trend in modern aircraft is to use composite and other non-metal materials, in lieu of metal, in the construction of the vehicle. While these composite materials offer significant reductions in weight, and permit the use of advanced molding methods to achieve perfect aerodynamic forms not previously possible with metal-forming, they also significantly increase risk of damage from electromagnetic fields such as airport radars, high-power radio and TV transmitters Composite materials reduce the beneficial "Faraday Cage" effect of the fuselage, increasing the importance of using other means to prevent voltage spikes from harming the internal systems.

In terrestrial applications, electrical isolation is achieved through transorbs, spark gaps, gas tubes, and transformer isolation. For example, transformers having large volumes of dielectric liquid, or large air gaps, can be used as isolation transformers because there are generally no significant space or weight restrictions. Further, transorbs or components that deteriorate over a number of uses can be easily replaced in terrestrial environments. However, in an aerospace vehicle, there are significant space and weight considerations, and components whose performance deteriorates after every use must be periodically inspected and/or replaced, increasing maintenance time and costs.

SUMMARY

Presented is a system and method that mitigates voltages spikes and other high voltage radiated fields or HIRF. The aircraft power system protection uses optimized isolation transformer modules in the aircraft power feeder circuits to provide isolation between the generators coupled to external wiring and the electronics systems inside the fuselage of the vehicle. In an embodiment, the optimized isolation transformer modules reduce voltage spikes in the electrical system from lightning and HIRF by approximately 30 db, or reducing the induced effects by approximately 1/1000 Volts and 1/10,000 Joules of the original Voltage or energy. This reduction in the coupling of energy to system inside the vehicle reduces the need to require special treatment in every electronic unit to handle voltage spikes.

The method comprises inserting a linear optimized isolation transformer between a generator and a portion of a power distribution system; directing each phase of the power distribution system into a separate linear optimized isolation transformer; and, positioning the linear optimized isolation transformers relative to structures of the vehicle to increase the electrical isolation of electrical components within the structures. In embodiments, the structures are the fuselage, the wing root where electrical cables from the generator enter a fuselage, the aft bulkhead where the auxiliary power unit (APU) is located, the electronics bay, or Faraday Cage structures in the vehicle. In embodiments, the linear isolation transformers are positioned so that the primary and secondary sides are on opposite sides of the structure.

The system comprises a linear optimized isolation transformer having a magnetic core with a primary side winding that is isolated from a secondary side winding by an isolation dielectric that maintains a high value isolation independent of pressure differences due to operation at different altitudes. In embodiments, linear optimized isolation transformers associated with each phase of a power distribution system electrically couple power from a generator through a structure of a vehicle to increase electrical isolation of electrical components inside the structure from electrical surges originating outside the structure.

The features, functions, and advantages discussed can be achieved independently in various embodiments of the present invention or may be combined in yet other embodiments further details of which can be seen with reference to the following description and drawings.

BRIEF DESCRIPTION OF THE DRAWINGS

The accompanying figures depict various embodiments of the system and method for providing isolation for vehicle power systems. A brief description of each figure is provided below. Elements with the same reference number in each figure indicated identical or functionally similar elements. Additionally, the left-most digit(s) of a reference number indicate the drawing in which the reference number first appears.

DETAILED DESCRIPTION

The following detailed description is merely illustrative in nature and is not intended to limit the embodiments of the invention or the application and uses of such embodiments. Furthermore, there is no intention to be bound by any expressed or implied theory presented in the preceding technical field, background, brief summary or the following detailed description.

There is a need to provide electrical isolation between the power generators in an aerospace vehicle and the internal electronics systems inside the vehicle that use the power from the power generators. Lightning strikes or high intensity radiated fields (HIRF) can create or induce voltage spikes that travel through the power lines leading from the power generators to the internal electronics systems inside the vehicle. The system and method of the present disclosure present a linear optimized isolation transformer for providing isolation for vehicle power systems.

Figure 1:
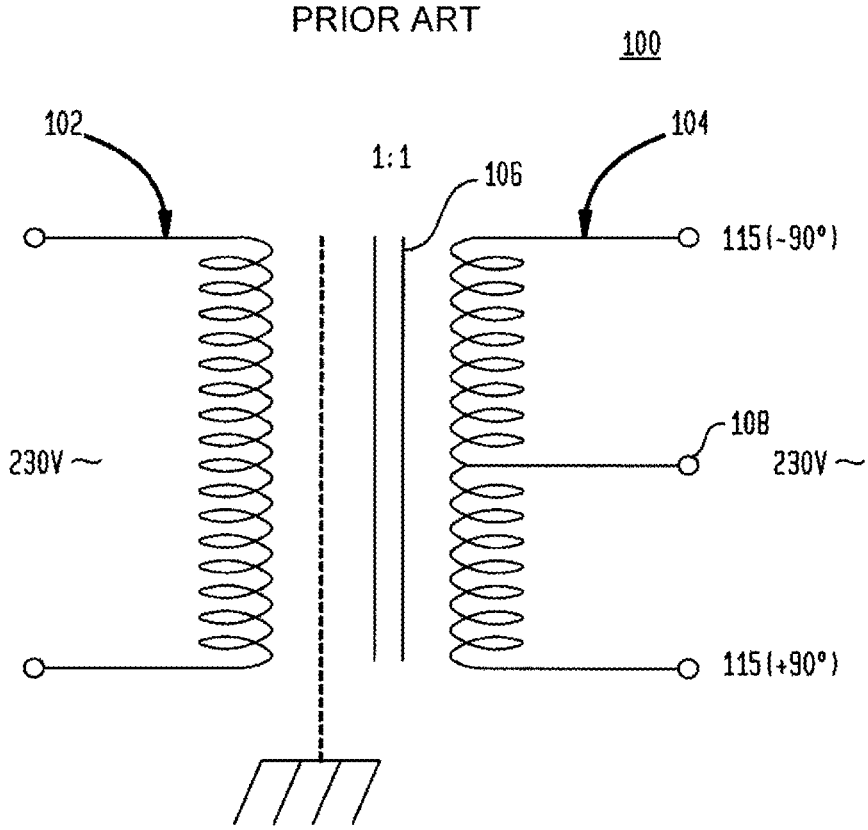
FIG. 1 PRIOR ART
FIG. 1 is a diagram of a conventional isolation transformer.

Referring now to FIG. 1, an electrical diagram of a conventional isolation transformer 100 is presented. Although the conventional isolation transformer 100 is shown for a single phase system, multiple conventional isolation transformers 100 can be used to provide isolation for three phase power systems as would be understood in the art. The conventional isolation transformer 100 has a primary side 102 and a secondary side 104. In the conventional isolation transformer 100, the wires of the primary side 102 are wound over the core 106 of the conventional isolation transformer 100, and the wires of the secondary side 104 are wound over the top of the wires of the primary side 102. The wires are electrically insulated from each other, and the wires of the primary side 102 and secondary side 104 are electrically isolated from each other by a non-conductive electrostatic shield. Energy transfer from the primary side 102 to the secondary side 104 is effected only by magnetic coupling between the primary side 102 and secondary side 104. By using equal numbers of windings in the primary side 102 and secondary side 104, the conventional isolation transformer 100 provides the same voltage on the secondary side 104 as the voltage presented to the primary 102. The conventional isolation transformer 100 is therefore said to be a 1:1 transformer. By including a center tap 108, a reduced amount of voltage can be obtained on the secondary side 110. For high power applications, the conventional isolation transformer 100 is sometimes placed in a dielectric container filled with a dielectric oil, and the terminals of the primary side 102 and secondary side 104 are physically distanced from one another to prevent arcing between the terminals.

Although the conventional isolation transformer 100 provides good electrostatic isolation between the primary side 102 and the secondary side 104, there is little electromagnetic protection. Because the windings are directly on top of one another, surges on the primary side 102 can be electromagnetically coupled to the secondary side 104. The core 106 acts as a reactive choke to some degree, but the proximity of the wires of the primary side 102 and secondary side 104 enable substantial energy to couple between the wires.

Isolation transformers, are seldom used in aircraft because the 115 Vac 400 Hz systems do not have transformers, and the extra weight of two isolation transformers does not trade-off well against bundle-shields, on the basis of protection from surges. However, one aspect of this disclosure is the design and placement of isolation transformers that prevent surges from occurring, rather than protection from surges that have already entered the vehicle.

Figure 2:
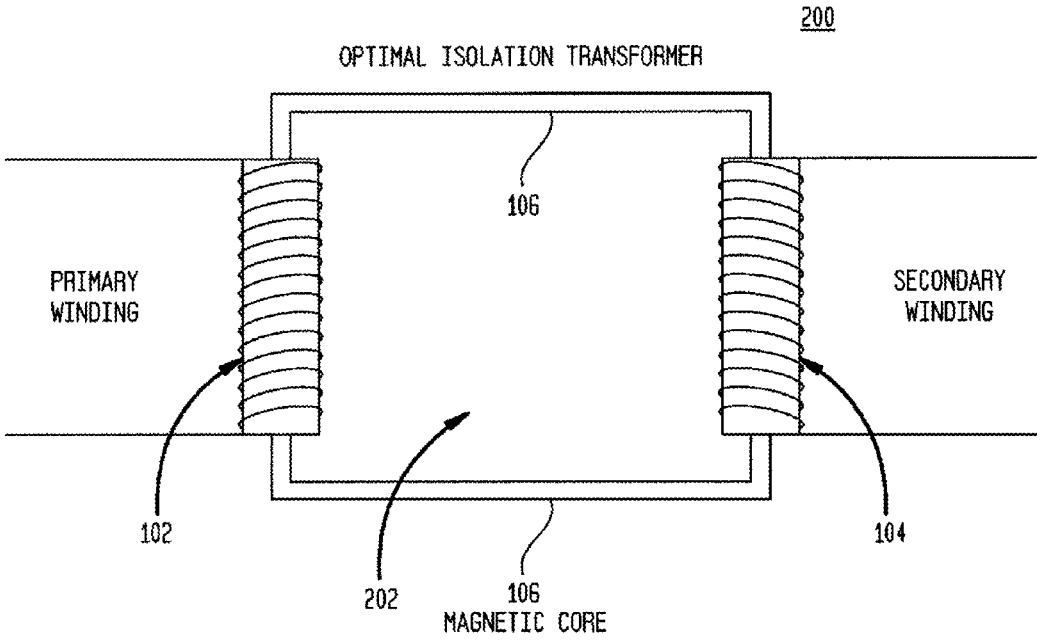
FIG. 2 PRIOR ART
FIG. 2 is a diagram of an optimal isolation transformer in one embodiment of the system and method for providing isolation for vehicle power systems.

Referring now to FIG. 2, an optimal isolation transformer 200 that provides both electrostatic and electromagnetic isolation is presented. The optimal isolation transformer 200 has a primary side 102 and a secondary side 104. In the optimal isolation transformer 200, the wires of the primary side 102 are wound over one part of the core 106 of the optimal isolation transformer 200, and the wires of the secondary side 104 are wound over a different part of the core 106 of the optimal isolation transformer 200. The primary side 102 and secondary side 104 are separated by an air gap 202. The air gap 202 prevents the primary side 102 and secondary side 104 from directly coupling energy, and instead forces all electromagnetic coupling to be performed though the core 106. The core 106 acts as a reactive electromagnetic choke, preventing large amounts of energy at high slew rates, such as those energies induced by a lightning strike, from being coupled from the primary side 102 to the secondary side 104.

However, although the use of an air gap 202 is satisfactory for terrestrial applications, it is not acceptable for use in an aerospace vehicle where operation of the optimal isolation transformer 200 would also occur at high altitudes. This is because voltage breakdown flashover between terminals changes with altitude, in accordance with the Paschen curve.

Figure 3:
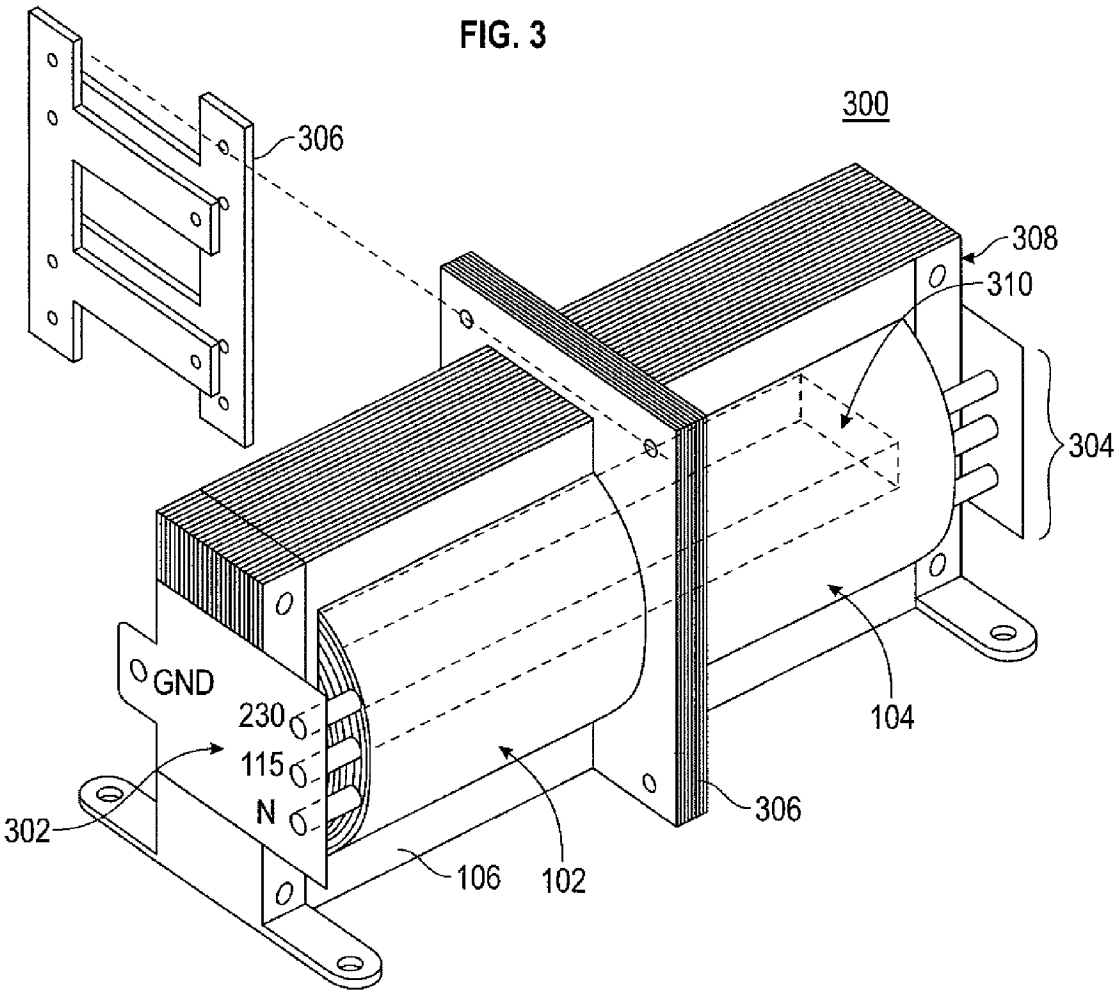
FIG. 3 is a diagram of a linear optimized isolation transformer in one embodiment of the system and method for providing isolation for vehicle power systems.

Referring now to FIG. 3, the solution is to use a permanent high-Q material isolation dielectric 306 between the primary side 102 and the secondary side 104 of a linear optimized isolation transformer 300. The isolation dielectric 306 provides similar electromagnetic isolation as the air gap 202 of the optimal isolation transformer 200 of FIG. 2, but with two additional advantages. First, because the isolation dielectric 306 is not a gas, the isolation dielectric is not affected by changes in altitude as is the air gap 202 of the optimal isolation transformer 200. This feature allows the linear optimized isolation transformer 300 to be used in a wide range of aerospace applications. Second, because the isolation dielectric 306 can be a higher Q than air, the isolation dielectric permits the primary side 102 and secondary side 104 of the linear optimized isolation transformer 300 to be in closer proximity compared to the primary side 102 and the secondary side 104 of an optimal isolation transformer 200 that employs an air gap 202. This reduces the necessary size or length of the linear optimized transformer 300 compared to the optimal isolation transformer 200. Further, unlike the air gap 202, the isolation dielectric 306 can be configured to extend beyond the core 106, providing further suppression of potential arcing.

In an embodiment of the linear optimized transformer 300, wires of a primary side 102 are wound around one portion of a center core member 310 of a squared-off figure-eight shaped core 308. In an embodiment the core is an iron core. Wires of a secondary side 104 are wound around a second portion of a center core structure of the figure-eight shaped core 308. The figure-eight shaped core 308 comprises a set of laminated layers configured to reduce eddy currents and associated losses due to eddy currents in the figure-eight shaped core 308. The figure-eight shaped core 308 extends from the primary side 102 to the secondary side 104. Between the primary side 102 and secondary side 104, an isolation dielectric 306 separates the primary side 102 from the secondary side 104.

The isolation dielectric 306 is comprised of a set of laminated members having a shape that fills all of the space between the primary side 102 and the secondary side that is not occupied by the figure-eight shaped core 308. In an embodiment, the isolation dielectric 306 is an H-shape having two crossbar members as illustrated in FIG. 3. In an embodiment, the isolation dielectric 306 comprises layer members that interlock to facilitate assembly of the isolation dielectric 306 onto an existing figure-eight shaped core 308. In an embodiment, the isolation dielectric 306 extends beyond the figure-eight shaped core 308 on at least one side, for example by having an additional top crossbar. In an embodiment, the isolation dielectric 306 extends beyond the figure-eight shaped core 308 on all sides.

In an embodiment, the primary side terminals 302 and secondary side terminals 304 are provided on opposite sides of the linear optimized transformer 300. This separation of the primary side terminals 304 and secondary side terminals 306 provides superior electrostatic isolation.

In an embodiment, the linear optimized transformer 300 is a 1:1 isolation transformer. In embodiments the linear optimized transformer 300 is a 1:x or x:1 isolation transformer, where x is a real number greater than 1. For example, if the generator provides 230V power, and the system to be powered requires 115V power, then the linear optimized transformer 300 can be adapted to be a 2:1 transformer. In an embodiment, the linear optimized transformer 300 has one or more taps for 1:x or x:1 power coupling. For example, if two 115V power systems on the secondary side are to be powered using a single 230V power source fed to the primary side, then a center tap in the linear optimized transformer 300 can provide power to each 115V power system, each of which has a 2:1 power coupling ratio. In an embodiment, the linear optimized transformer 300 provides a 1:x step down voltage appropriate for providing power for 28 Vdc avionic systems.

In embodiments, the linear optimized transformer 300 further comprises one or more transorbs, gas-discharge tubes, or other semiconductor or equivalent electronics to perform, for example, further R.F. choke or surge protection functionality.

Many aerospace vehicles use generators that are part of, or integrated into, the engines or jet turbines of an aircraft 400. Power from the engines or jet turbines is typically generated as three-phase power. In an embodiment, three linear optimized transformers 300 are used to provide power isolation for each phase of a three-phase power generator.

Figure 4:
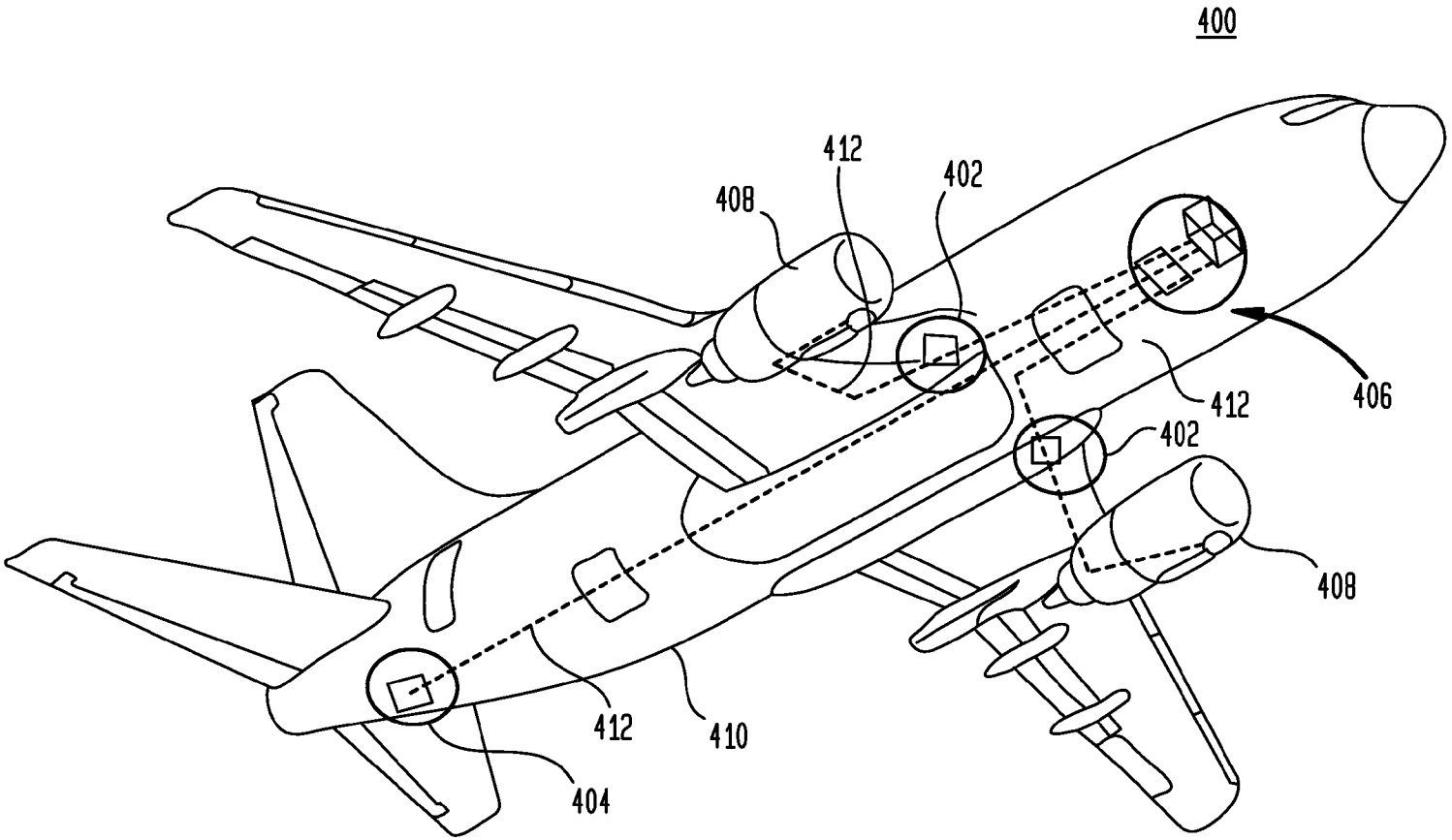
FIG. 4 is a diagram of placement of linear optimized isolation transformers in an aerospace vehicle in one embodiment of the system and method for providing isolation for vehicle power systems.

Referring now to FIG. 4, an aircraft 400 comprises one or more linear optimized transformers 300. Each of the linear optimized transformers 300 is used to isolate power from a generator coupled to a source such as a jet turbine engine 408 or auxiliary power unit or APU 404. In one embodiment, one or more linear optimized transformers 300 is positioned within the wing root 402 where long electrical cables 412 come from the generator associated with the engine 408 into the fuselage 410. In an embodiment, the primary side terminals 302 reside outside the fuselage 410 in the wing root 402, whereas the secondary side terminals 306 reside inside the fuselage 410. In this embodiment, the linear optimized transformers 300 help to ensure that charge does not enter the "Faraday Cage" environment of the fuselage 410 through the electrical cables in the wing root 402. In another embodiment, linear optimized transformers 300 are placed near the aft pressure bulkhead near the APU 404 to isolate the long electrical cables 412 leading from the APU 404 to the avionics bay 406 in the front of the aircraft 400. Electric cables 412 leading from the APU 404 to the avionics bay 406 are typically the longest cables and can be 200 ft or more. Collectively the electric cables 412 and power systems inside the avionics bay 406 comprise a power distribution system. Generally, the longer the aircraft 400 and the longer the electric cables 412, the worse the induction effects become from lightning strikes and other HIRF.

Figure 5:
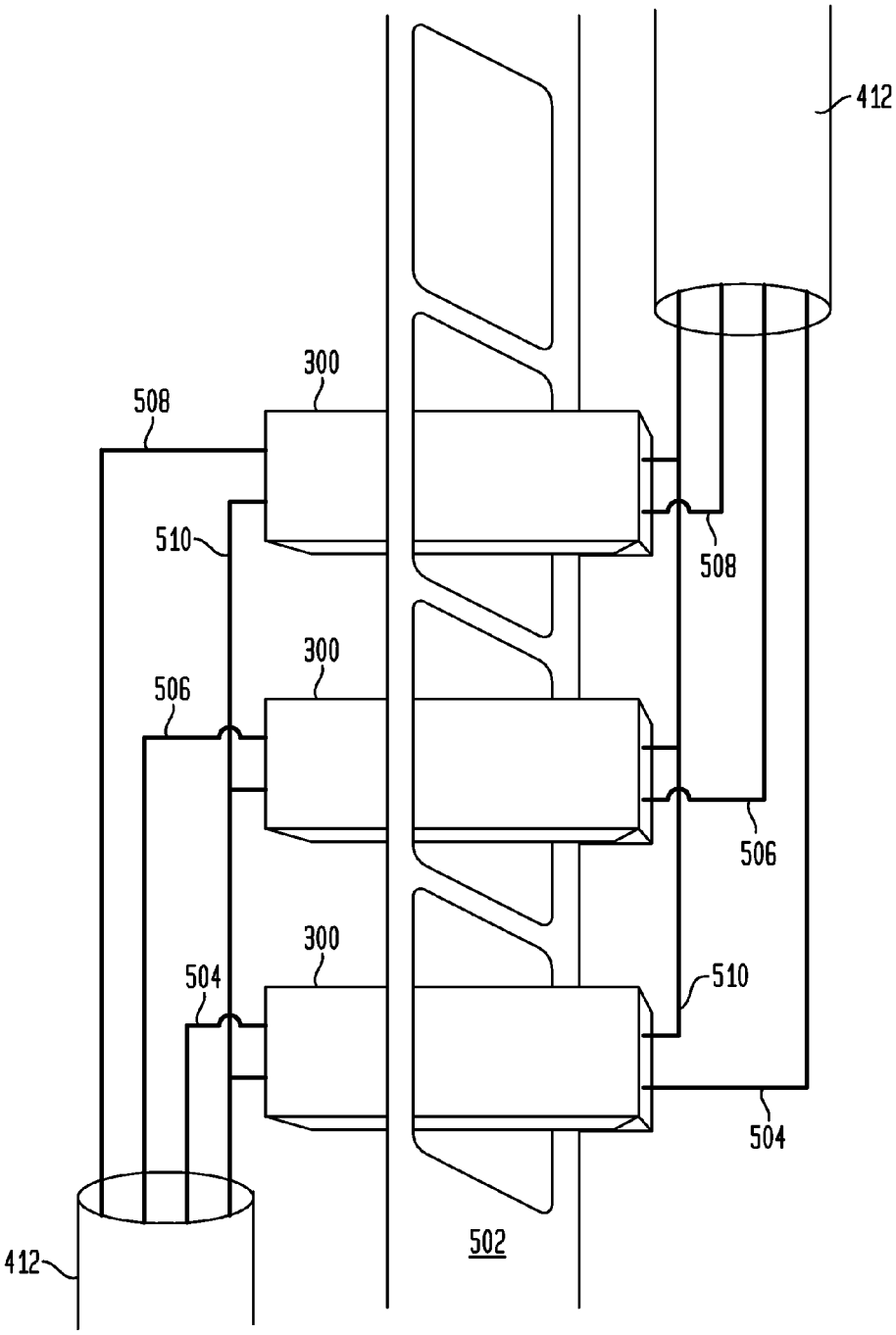
FIG. 5 is a diagram of placement of linear optimized isolation transformers through a structure of a vehicle in one embodiment of the system and method for providing isolation for vehicle power systems.

Referring now to FIG. 5, a diagram of three linear optimized transformers 300 are illustrated passing through a structure 502, for example a structure 502 associated with an aircraft fuselage 410 or wing root 402. Each phase, 504, 506, and 508 of the electrical cable attaches to a different linear optimized transformer 300. The neutral wire 510 from each of the electrical cable 412 connects to the neutral terminals of each of the three linear optimized transformers 300. The linear optimized transformers 300 help to ensure that charge does not pass through the structure 502.

In an embodiment, linear optimized transformers 300 are used to isolate the components and systems inside the avionics bay 406 from the electric cables 412 delivering power from the generator associated with the engine 408 or APU 404. In some aircraft 400, the avionics bay 406 is isolated from the rest of the fuselage 410 by a cage that functions as a Faraday Cage to protect the components and systems inside of the avionics bay 406. The cage serves to protect critical avionics flight control systems and navigation equipment from induced power surges. Passenger entertainment systems and other systems may similarly reside in the cage or in their own cage. In an embodiment, one or more linear optimized transformers 300 are positioned in proximity to the avionics bay 406 to provide power isolation. In a non-limiting example, the primary side terminals 302 reside outside the avionics bay, while the secondary side terminals 306 reside inside the avionics bay 406.

Figure 6:
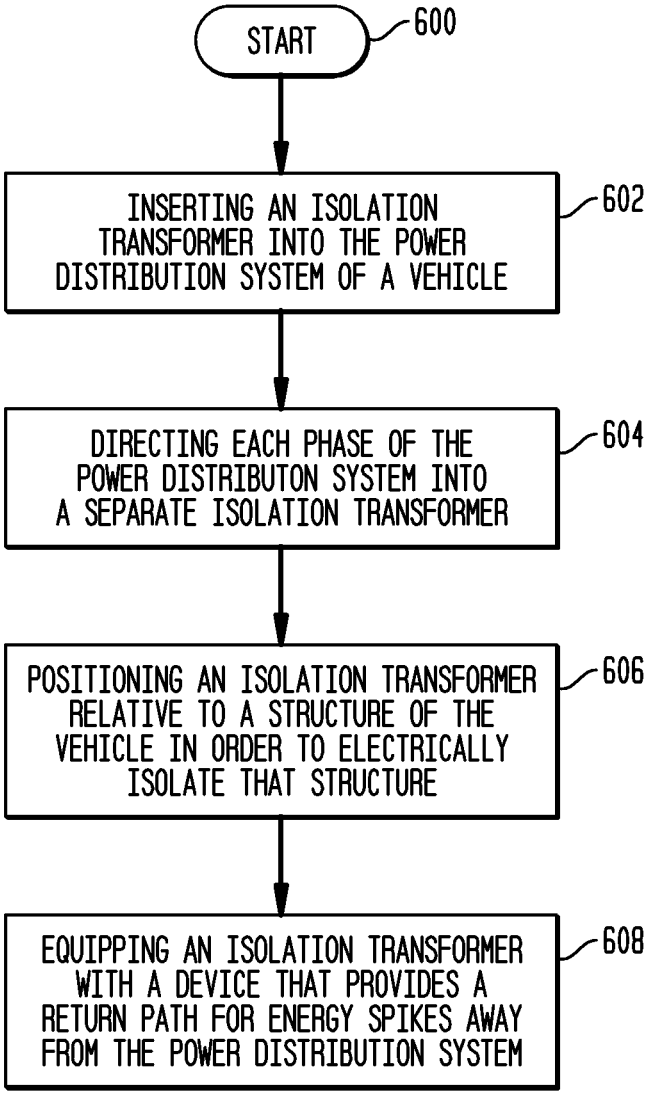
FIG. 6 is a flowchart of a process of placing linear optimized isolation transformers in a vehicle in one embodiment of the system and method for providing isolation for vehicle power systems.

Referring now to FIG. 6, a simplified process 600 of implementing a linear optimized transformers 300 in a vehicle such as an aircraft 400 is presented. In a first step, a linear optimized transformer 300 is inserted 602 between the outputs of the generator and the power distribution system. For example, the linear optimized transformer 300 is placed inline with one or more of the electrical cables 412. In embodiments, the generator is on the engine 408 or APU 404. Because most vehicle generators provide 3-phase power, in a second step, each phase of the power distribution system is directed 604 into separate linear optimized transformers 300. In a third step, the linear optimized transformers 300 are positioned 606 relative to a structure of the vehicle in order to electrically isolate that structure. In embodiments, the linear optimized transformers 300 are positioned 606 in the wing root 402 in proximity to the avionics bay 406 and in proximity to the APU 404, or placed between electrical cables 412 included in the power distribution system. In embodiments, the linear optimized transformers 300 are co-located, packaged together, or individually positioned independently from one another depending on available space in the vehicle or isolation design parameters. For example, in one embodiment the linear optimized transformers 300 can be separated from one another to prevent a localized lightning strike from affecting all of the linear optimized transformers 300. In another embodiment, the linear optimized transformers 300 are positioned together so that a lightning strike will affect all of the linear optimized transformers 300 in approximately the same temporal frame, and thus any small amount of voltage surge that passes through the linear optimized transformers 300 will be common mode. In embodiments, in a fourth step, the linear optimized transformers 300 are equipped 608 with a device that provides a return path to divert energy spikes away from the power distribution system. For example, one or more transorbs, gas-discharge tubes, or other semiconductor or equivalent electronics will perform additional RF choke or surge protection functionality.

The embodiments of the invention shown in the drawings and described above are exemplary of numerous embodiments that may be made within the scope of the appended claims. It is contemplated that numerous other configurations of the system and method for providing electrical isolation for vehicle power systems may be created taking advantage of the disclosed approach. It is the applicant's intention that the scope of the patent issuing herefrom will be limited only by the scope of the appended claims.

What is claimed is:

1. A method for power system isolation in a vehicle, the method comprising:

providing a linear transformer of a type having a figure-eight shaped core with a center core member, and wires of a primary side wound around one portion of said center core member, and wires of a secondary side wound around a second portion of said center core member, said linear transformer including an isolation dielectric having an H shape that fills all of the space between the primary side and the secondary side that is not occupied by the figure-eight shaped core;

placing said linear transformer in line with at least one electrical cable between an output of a generator and one or more components and systems receiving power from said generator inside a cage that functions as a Faraday Cage to protect said one or more components and systems; and positioning said linear transformer relative to said cage such that primary side terminals of said linear transformer reside outside said cage and secondary side terminals of said linear transformer reside inside said cage, thereby providing power isolation for said one or more components and systems inside said Faraday Cage from said electrical cable.

2. The method of claim 1, further comprising:

equipping said linear transformer with means for providing a return path for energy spikes that reduces coupling of the energy spike into said power distribution system.

3. The method of claim 2, wherein said means for providing a return path for energy spikes is selected from the group consisting of a transorb, a gas tube, Zener diode, and a back-to-back Schottky Barrier diode.

4. The method of claim 1, wherein said isolation dielectric placed between said wires of said primary side and said wires of said secondary side includes a set of laminated members.

5. The method of claim 4, wherein said isolation dielectric comprises a high-Q material selected to maintain a high value isolation independent of pressure differences resulting from operation of the vehicle at different altitudes.

6. The method of claim 4, wherein said isolation dielectric has an outer diameter greater than a diameter of said magnetic core, said wires of said primary side wound around said center portion of said center core, and said wires of said secondary side wound around said center portion of said center core.

7. The method of claim 4, wherein said primary side terminal and said secondary side terminal are positioned on opposing ends of a long axis of said magnetic core.

8. The method of claim 4, further comprising said primary side wires and said secondary side wires forming a space between them, and wherein said isolation dielectric has a shape that fills all of said space that is not occupied by said figure-eight shaped magnetic core.

9. The method of claim 1, wherein said cage is selected from the group consisting of a fuselage, a wing root where electrical cables from a generator enter a fuselage, an aft bulkhead in proximity to an auxiliary power unit (APU), and an electronics bay.

10. The method of claim 1, wherein said generator is selected from the group consisting of an auxiliary power unit (APU), and a generator associated with a jet turbine engine.

11. The method of claim 1, wherein said cage is an avionics bay of said vehicle.

12. A vehicle, comprising:

a multi-phase power distribution system that electrically couples a generator to at least one electrical component;

a cage that functions as a Faraday Cage into which electrical power from said generator passes, said cage housing said at least one electrical component; and a plurality of linear transformers of a type having a figure-eight shaped core with a center core member, and wires of a primary side wound around one portion of said center core member and having primary side terminals, and wires of a secondary side wound around a second portion of said center core member, each of said linear transformers including an isolation dielectric having an H shape that fills all of the space between the primary side and the secondary side that is not occupied by the figure-eight shaped core, and having secondary side terminals, each of said plurality of linear transformers associated with a different phase of said multi-phase power distribution system and positioned relative to said cage such that said primary side terminals of said linear transformer reside outside said cage and said secondary side terminals of said linear transformer reside inside said cage, thereby providing power isolation for said at least one electrical component inside said cage.

13. The vehicle of claim 12, wherein said cage is selected from the group consisting of a fuselage, a wing root, an aft bulkhead in proximity to an auxiliary power unit (APU), and an electronics bay.

14. The vehicle of claim 12, wherein each of said plurality of linear transformers further comprises:

a figure-eight shaped magnetic core having a primary side and a secondary side;

said isolation dielectric comprising a set of laminated members placed between said primary side and said secondary side, said set of laminated members comprising a high-Q material selected to maintain a high value isolation independent of pressure differences resulting from operation at different pressures; and wherein said primary side terminals and said secondary side terminals are positioned on opposing ends of a long axis of said magnetic core.

15. The vehicle of claim 12, further comprising:

surge reduction means associated with each of said plurality of linear transformers that provides a return path for said electrical surges away from said power distribution system.

* * * * *